US012467357B2

(12) United States Patent
Parker et al.

(10) Patent No.: US 12,467,357 B2
(45) **Date of Patent: *Nov. 11, 2025**

(54) FORMATION TESTING TOOL AND METHODS FOR PERFORMING A HYBRID POWER FORMATION PRESSURE TEST

(71) Applicant: Halliburton Energy Services, Inc., Houston, TX (US)

(72) Inventors: Jason Charles Parker, Houston, TX (US); Anthony Herman VanZuilekom, Houston, TX (US); Thiago Santos Magalhaes, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/439,846

(22) Filed: Feb. 13, 2024

(65) Prior Publication Data

US 2025/0257655 A1 Aug. 14, 2025

(51) Int. Cl.
*E21B 49/08* (2006.01)
*E21B 47/18* (2012.01)

(52) U.S. Cl.
CPC ..... *E21B 49/087* (2013.01); *E21B 47/18* (2013.01)

(58) Field of Classification Search
CPC ..... E21B 49/087; E21B 49/08; E21B 49/081; E21B 47/18
See application file for complete search history.

(56) References Cited

U.S. PATENT DOCUMENTS

| | | | |
|---|---|---|---|
| 4,216,536 | A | 8/1980 | More |
| 6,843,118 | B2 | 1/2005 | Weintraub et al. |
| 7,216,533 | B2 | 5/2007 | McGregor et al. |
| 11,008,853 | B2 | 5/2021 | Jones et al. |
| 2002/0011333 | A1 | 1/2002 | Ward |
| 2002/0149498 | A1 | 10/2002 | Tabanou |

(Continued)

FOREIGN PATENT DOCUMENTS

| | | | |
|---|---|---|---|
| CN | 114922601 | A | 8/2022 |
| WO | 2013009801 | A2 | 1/2013 |

OTHER PUBLICATIONS

International Search Report and Written Opinion dated Oct. 29, 2024 for PCT Application No. PCT/US2024/015502 filed Feb. 13, 2024.

(Continued)

*Primary Examiner* — Caroline N Butcher
(74) *Attorney, Agent, or Firm* — K&L Gates LLP

(57) ABSTRACT

Methods and systems for performing a formation pressure test include inserting a bottom hole assembly ("BHA") into a wellbore. The BHA includes a drill bit and a formation testing tool with a battery and a fluid powered generator. An initial formation pressure test is performed while powering the formation testing tool with the fluid powered generator during the entire initial test. At least a portion of a formation pressure test is performed powering the formation testing tool with the battery during while the fluid powered generator is unavailable due to insufficient fluid circulation in the wellbore. The method also includes determining, using a processor, at least one characteristic of the formation based on results of the initial formation pressure test and the formation pressure test.

17 Claims, 5 Drawing Sheets

(56) References Cited

U.S. PATENT DOCUMENTS

| | | | | |
|---|---|---|---|---|
| 2011/0198076 | A1* | 8/2011 | Villreal | E21B 21/08 166/250.01 |
| 2015/0047836 | A1 | 2/2015 | Mitchell | |
| 2020/0284140 | A1* | 9/2020 | Jones | E21B 47/06 |
| 2021/0164342 | A1 | 6/2021 | Jones | |

OTHER PUBLICATIONS

International Search Report and Written Opinion dated Nov. 4, 2024 for PCT Application No. PCT/US2024/015523 filed Feb. 13, 2024.

* cited by examiner

FORMATION TESTING TOOL AND METHODS FOR PERFORMING A HYBRID POWER FORMATION PRESSURE TEST

BACKGROUND

Geologists and geophysicists are interested in the characteristics of the formations encountered by a drill bit as it is drilling a well for the ultimate production of hydrocarbons from the earth. Such information is useful in determining the correctness of the geophysical data used to choose the drilling location and in choosing subsequent drilling locations. In horizontal drilling, such information can be useful in determining the location of the drill bit and the direction that drilling should follow.

Such information can be derived using an approach called "measurement while drilling" ("MWD") or "logging while drilling" ("LWD") in which tools are included in a drillstring that collect formation data while the drill bit remains in the borehole. One type of MWD tool is a formation testing tool that measures formation pressure, which can be used for a variety of purposes, including computing the permeability and porosity of the formation.

Testing the formation using a formation testing tool incorporated into the drillstring is desirable in that the drillstring does not need to be removed to conduct the test. During drilling operations, it is generally preferable to have the mud pumps engaged as much as possible to prevent the drillstring from sticking in the hole. Additionally mud flow allows downhole generators or turbines to remain active and supply power to any downhole tools. Mud flow also allows for mud pulse telemetry where a downhole tool restricts the mud flow to create pressure waves that may be detected at the surface, allowing encoding transmission of data to the surface by encoding information into these pressure waves.

In the case of a formation testing while drilling, power from a generator may be necessary to provide sufficient power for the high drawdown rates necessary to achieve accurate results from a formation pressure test. Having mud pulse telemetry available during this testing is also beneficial as the telemetry may allow the surface operators to detect and correct for failed tests, such as when the tool does not properly seal to the formation.

However, having mud pumps engaged and creating fluid flow during a formation pressure test also causes noise that negatively impacts the measurement quality. Therefore, in certain such testers, the flow of drilling fluid must be stopped in order to measure the formation pressure or take a sample of the formation fluid. When this occurs, without the flow of constantly moving drilling fluid, the bottom hole assembly ("BHA") can become stuck in the hole, necessitating a costly and time consuming procedure to free the stock tool. Furthermore, stopping the flow of drilling fluid prevents the mud turbine generator from generating the needed electrical power, and power to operate the formation tester must be supplied by other means, such as batteries which, in certain instances, may be less reliable or otherwise less desirable because of insufficient power to power a completely formation pressure test by the formation testing tool. For example, in situations with high mobility formations a high drawdown rate may be required which may be impractical using battery power alone due to the limited power capabilities of existing battery technology.

Accordingly there remains a desire to be able to achieve the benefits of pumps on (higher power for drawdowns, mud pulse telemetry) while preserving measurement quality form pumps off operation.

BRIEF DESCRIPTION OF THE DRAWINGS

Aspects of the disclosure are described with reference to the following figures, the features of which are not necessarily shown to scale. Some details of elements may not be shown or may be represented by conventional symbols in the interest of clarity and conciseness.

DETAILED DESCRIPTION

The present disclosure describes improved system and method for conducting a formation pressure test using a formation testing tool while conducting a drilling operation. During a formation pressure test, the formation testing tool performs a number of operations, such as a drawdown and a buildup. Further multiple such drawdowns and buildups may be performed during a formation pressure test. These operations require power to operate the formation testing tool. The present disclosure describes a drilling system with the formation pressure testing tool that may be powered by a hybrid power system that includes both power generated from a fluid flow generator or turbine and a battery downhole. The formation pressure testing tool does not use one source of power or the other for a complete formation pressure test. Instead, the formation testing tool is powered during a formation pressure test by either a fluid generator or a battery depending on the operation being performed during the formation pressure test. The systems and methods describe the ability to switch between power sources during a single formation pressure test as well as the ability to coordinate turning off the mud pump during portions of the test where the formation pressure testing tool is powered by battery. The formation testing tool thus uses both a higher power generator to enable a high power drawdown, and then can switch to battery power to enable a low noise buildup. The formation testing tool will perform the drawdown and then coordinate with the surface for the mud pumps to be turned off for only as long as necessary to compete a successful pressure test buildup. Pressure measurements with the pumps off can provide more accurate pressure measurements, improving the ability to assess the location and producibility of oil and gas downhole. In this manner, both improved drawdown rates and high quality formation pressure tests can both be achieved, with minimal pumps off time, alleviating some of the issues associated with not operating the mud pump described above. Alternatively, although the formation testing tool includes the generator, the entire formation pressure test may be performed with the mud pump turned off and the formation testing tool powered only by the battery.

Figure 1:
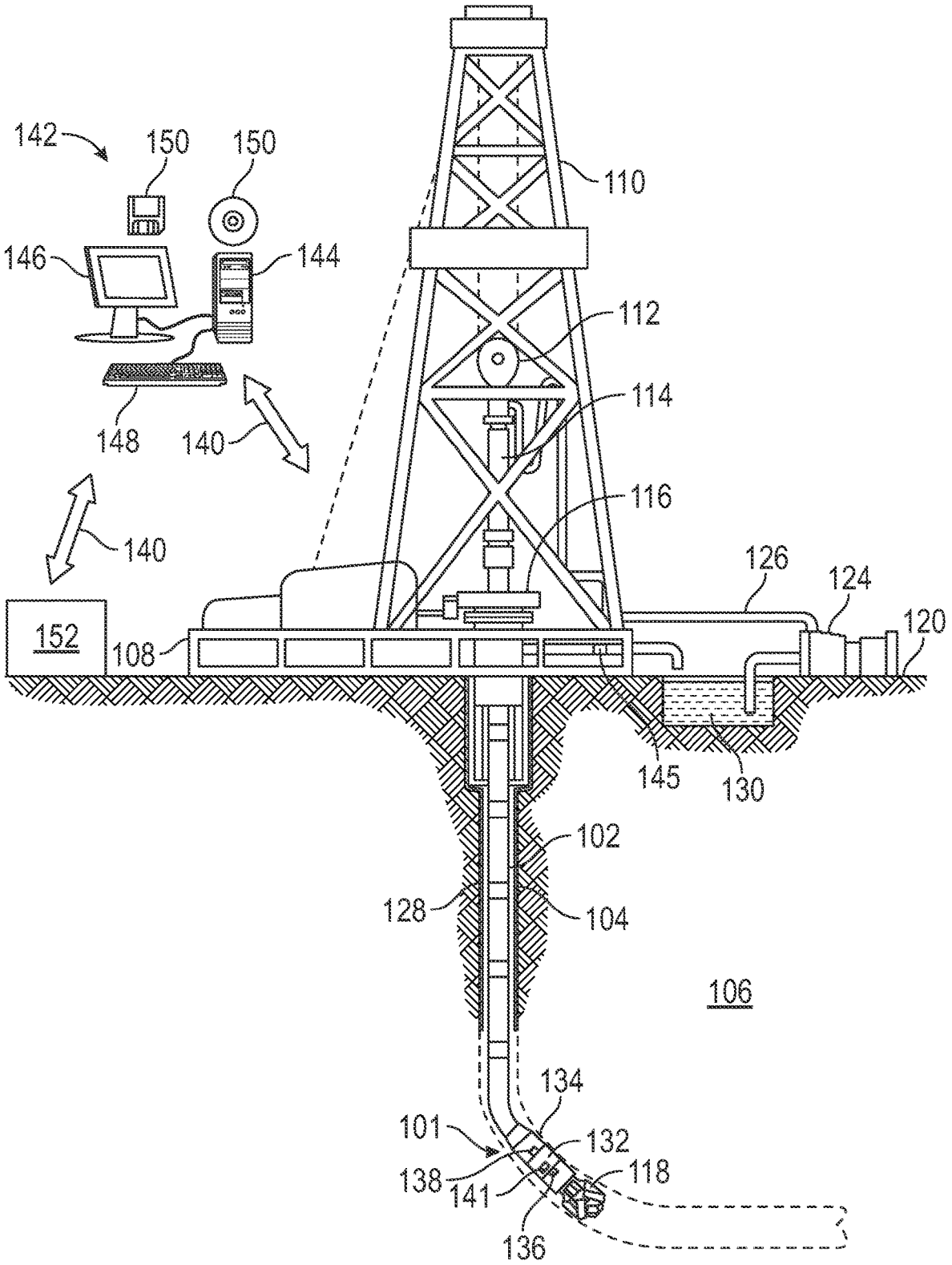
FIG. 1 is a schematic diagram of an example of a formation testing tool on a drillstring in accordance with one or more embodiments.

FIG. 1 is a schematic diagram that shows a drilling system 100 with a formation testing tool 101 disposed on a drillstring 102. As illustrated, a wellbore 104 may extend through a subterranean formation 106. In examples, reservoir fluid may be contaminated with well fluid (e.g., drilling fluid) from the wellbore 104. As described herein, a fluid sample may be analyzed to determine fluid contamination and other fluid properties of the reservoir fluid. As shown the wellbore 104 extends generally vertically into the subterranean formation 106 for a portion of the wellbore and also extends at an angle to vertical through the subterranean formation 106, such as horizontal or slanted section. Thus, both vertical or low inclination angle wells and high inclination angles or horizontal placement of the well and equipment are possible. It should further be noted that while FIG. 1 generally depicts a land-based operation, those skilled in the art will readily recognize that the principles described herein are equally applicable to subsea operations that employ floating or sea-based platforms and rigs, without departing from the scope of the disclosure.

As illustrated, a drilling platform 108 may support a derrick 110 having a traveling block 112 for raising and lowering the drillstring 102. The drillstring 102 may include, but is not limited to, drill pipe and coiled tubing, as generally known to those skilled in the art. A kelly 114 may support the drillstring 102 as the drillstring 102 may be lowered through a rotary table 116. A drill bit 118 may be attached to the distal end of drillstring 102 and may be driven either by a downhole motor and/or via rotation of drillstring 102 from the surface 120. Without limitation, the drill bit 118 may include, a roller cone bit, a PDC bit, a natural diamond bit, a hole opener, a reamer, a coring bit, and the like. As the drill bit 118 rotates, the drill bit 118 creates and extends the wellbore 104 that penetrates various subterranean formations 106. A mud pump 124 circulates drilling fluid through a feed pipe 126 to the kelly 114, downhole through interior of the drillstring 102, the through orifices in drill bit 118, back to the surface 120 via annulus 128 surrounding the drillstring 102, and into a retention pit 130.

The drill bit 118 may be just one piece of a downhole assembly ("BHA") that may include one or more drill collars 132 and the formation testing tool 101. The formation testing tool 101, which may be built into the drill collars 132 may gather measurements and fluid samples as described herein. One or more of the drill collars 132 may form a tool body 134. The tool body 134 may be any suitable material, including without limitation titanium, stainless steel, alloys, plastic, combinations thereof, and the like.

The formation testing tool 101 may further include one or more sensors 136 for measuring properties of the fluid sample of the reservoir fluid, the wellbore 104, the subterranean formation 106, or the like. The properties of the fluid are measured as the fluid passes from the formation 106 through the testing tool 101 and into either the wellbore or a sample container. The formation testing tool 101 may obtain and separately store different fluid samples from the subterranean formation 106 in a fluid analysis module 138. In examples, the fluid analysis module 138 may be operable to process information regarding a fluid sample, as described below.

In examples, the fluid analysis module 138 may include at least one a sensor that may continuously monitor a reservoir fluid. Such sensors include optical sensors, acoustic sensors, electromagnetic sensors, conductivity sensors, resistivity sensors, selective electrodes, density sensors, mass sensors, thermal sensors, chromatography sensors, viscosity sensors, bubble point sensors, fluid compressibility sensors, flow rate sensors, pressure sensors, voltage sensors, vibration sensors, or turbine/generator rotational speed (rpm) sensors. Sensors may also measure a contrast between drilling fluid filtrate properties and formation fluid properties.

In examples, fluid analysis module 138 may be a gas chromatography analyzer ("GC"). A GC may separate and analyze compounds that may be vaporized without decomposition. Fluid samples from the wellbore 104 may be injected into a GC column and vaporized. Different compounds may be separated due to their retention time difference in the vapor state. Analyses of the compounds may be displayed in GC chromatographs. In examples, a mixture of formation fluid and drilling fluid filtrate may be separated and analyzed to determine the properties within the formation fluid and drilling fluid filtrate.

The fluid analysis module 138 may be operable to derive properties of and characterize the fluid sample. By way of example, the fluid analysis module 138 may measure absorption, transmittance, or reflectance spectra and translate such measurements into component concentrations of the fluid sample, which may be lumped component concentrations, as described above. The fluid analysis module 138 may also measure gas-to-oil ratio, fluid composition, water cut, live fluid density, live fluid viscosity, formation pressure, and formation temperature. The fluid analysis module 138 may also be operable to determine fluid contamination of the fluid sample and may include any instrumentality or aggregate of instrumentalities operable to compute, classify, process, transmit, receive, retrieve, originate, switch, store, display, manifest, detect, record, reproduce, handle, or utilize any form of information, intelligence, or data. For example, the fluid analysis module 138 may include random access memory (RAM), one or more processing units, such as a central processing unit (CPU), or hardware or software control logic, ROM, and/or other types of nonvolatile memory.

Any suitable technique may be used for transmitting signals from the formation testing tool 101 to surface 120, including but not limited to mud pulse telemetry, electromagnetic telemetry, or acoustic telemetry. As illustrated, a communication link 140 (which may be wired or wireless, for example) may be provided that may transmit data from the formation testing tool 101 to an information handling system 142 at the surface 120. For purposes of the present disclosure, the embodiments described herein will be explained with respect to use of mud pulse telemetry. A telemetry transmitter 141 located in a drill collar 132 or elsewhere in the formation testing tool 101 and thus within the BHA collects data from the formation testing tool 101 and transmits the data through the mud via pressure pulses generated in the drilling mud. A telemetry sensor 145 on the surface 120 detects the telemetry and returns it to a demodulator in the information handling system 142. The demodulator demodulates the data and the information handling system 142 can then analyze the data.

Further, commands may be passed downhole to the formation testing tool 101 in a variety of ways. In addition to the methods described in the previous paragraph, information may be transmitted by performing predefined sequences of drill pipe rotations that can be sensed in the MWD tools and translated into commands. Similarly, the mud pumps may be cycled on and off in predefined sequences to transmit information in a similar fashion.

The information handling system 142 may include a processing unit 144 including at least one processor, a monitor 146, an input device 148 (e.g., keyboard, mouse, etc.), and/or computer media 150 (e.g., optical disks, magnetic disks) that can store code representative of the methods described herein. The information handling system 142 may act as a data acquisition system and possibly a data processing system that analyzes information from the formation testing tool 101. For example, the information handling system 142 may process the information from the formation testing tool 101 for determination of fluid contamination. The information handling system 142 may also determine additional properties of the fluid sample (or reservoir fluid), such as component concentrations, pressure-volume-temperature properties (e.g., bubble point, phase envelop prediction, etc.) based on the fluid characterization. This processing may occur at the surface 120 in real-time. Alternatively, the processing may occur downhole hole or at the surface 120 or another location after recovery of the formation testing tool 101 from the wellbore 104. Alternatively, the processing may be performed by an information handling system in the wellbore 104, such as the fluid analysis module 138. The resultant fluid properties may then be transmitted to the surface 120, for example, in real-time.

It should be noted that in examples a gas chromatographer 152 may be disposed on the surface 120 and analyze samples captures by the formation testing tool 101. For example, the fluid analysis module 138 may capture fluid samples and bring them to the surface 120 for analysis at the wellsite. As illustrated, the gas chromatographer 152 may be a standalone assembly that may be available at the wellsite. Additionally, the information handling system 142 may be connected to the gas chromatographer 152 through the communication link 140.

In certain embodiments, the pump 124 may be electrically coupled to a controller in the information handling system 142 that directs the operation of the pump 124. The controller sends one or more control signals to the pump 124 to control the speed/torque output of the pump 124. The control signals may take whatever form is necessary to communicate with the pump 124. For instance, a control signal to an electric pump may comprise an electrical control signal to a variable frequency drive coupled to the electric pump, which may receive the control signal and alter the operation of the electric pump based on the control signal. In other embodiments, some or all of the functionality associated with the controller may be located on the pump 124 such that the pump 124 may have an individual controller that directs the operation of the pump 124.

In a measurement-while-drilling or logging-while-drilling environment, such as that shown in FIG. 1, the formation testing tool 101 includes two power sources, a battery and a mud turbine or generator. As such, the BHA can further comprise one or more rechargeable batteries. Further, the generator is powered hydraulically by the flow of fluid through the drillstring 102. For example, while passing through the BHA, the flow of drilling fluid can be channeled through a turbine/alternator sub-assembly included in BHA (not specifically shown in FIG. 1). The turbine/alternator sub-section can be configured to convert the energy from the flow of drilling fluid into a mechanical rotational energy, which is turn can be used to drive an alternator portion of the sub-assembly, and thereby generate electrical power. The generated electrical power may then be conditioned and controllably applied to the formation testing tool 101. Control of which power source is being used for the power applied to the formation testing tool 101 can be performed from the surface 120 using the information handling system 142. In addition, or in the alternative, control of the power applied can be performed using one or more processors or controllers in the formation testing tool 101.

Figure 2:
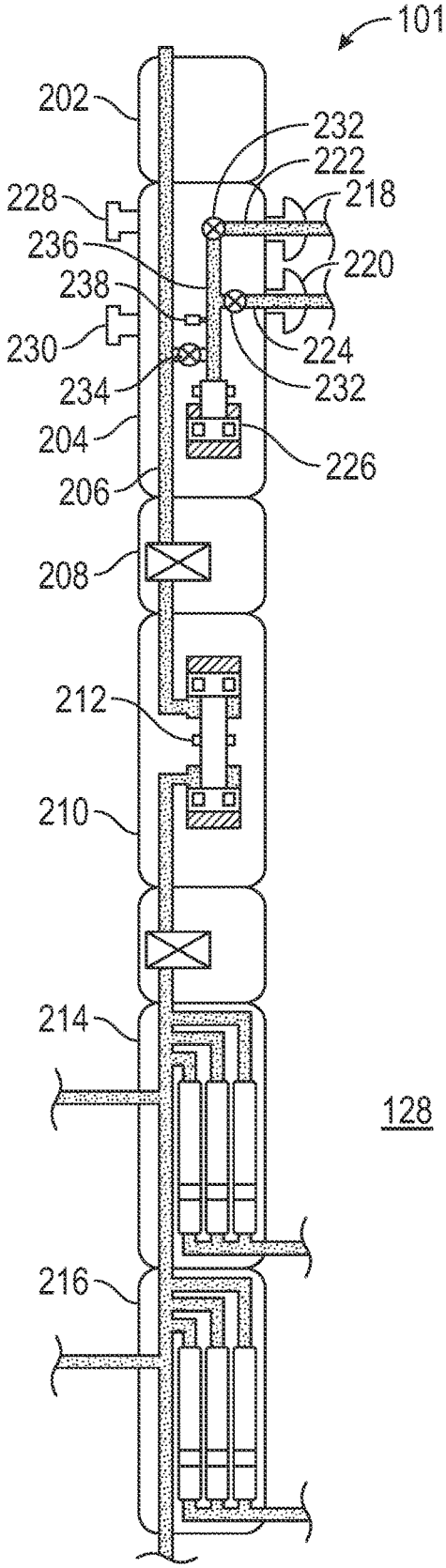
FIG. 2 is a schematic drawing of the formation testing tool in accordance with one or more embodiments.

FIG. 2 is a schematic of the formation testing tool 101. In examples, the formation testing tool 101 includes a power and telemetry section 202 through which the tool communicates power and data signals to and from other components and sensors 136 in the formation testing tool 101 (e.g., referring to FIG. 1), and with a surface telemetry system (not illustrated). In examples, the power and telemetry section 202 may also be a port through which the various actuators (e.g. valves) and sensors (e.g., temperature and pressure sensors) in the formation testing tool 101 may be controlled and monitored. In examples, the power and telemetry section 202 includes a computer with one or more processors that exercises the control and monitoring function. In one example, the control and monitoring function is performed by a computer in another part of the drillstring or by the information handling system 142 on the surface 120 (e.g., referring to FIG. 1). As explained above, the power and telemetry section 202 includes both a battery and a mud turbine or generator (not specifically shown). The power and telemetry section 202 may also include a mud pulse telemetry system (not specifically shown) for communicating with equipment on the surface 120. Although a mud pulse telemetry system is described, any suitable type of telemetry system may be used.

In examples, the formation testing tool 101 also includes a dual probe section 204, which extracts fluid from the reservoir and delivers it to a channel 206 that extends from one end of the formation testing tool 101 to the other. Without limitation, the dual probe section 204 includes two probes 218, 220 which may extend from the formation testing tool 101 and press against the inner wall of wellbore 104 (e.g., referring to FIG. 1). Probe channels 222, 224 may connect the probes 218, 220 to the channel 206. A high-volume bidirectional pump 212 may be used to pump fluids from the reservoir, through the probe channels 222, 224 and to the channel 206. Alternatively, a low volume pump 226 may be used for this purpose. Two standoffs or stabilizers 228, 230 hold the formation testing tool 101 in place as the probes 218, 220 press against the wall of wellbore 104. In examples, the probes 218, 220 and the stabilizers 228, 230 may be retracted when the formation testing tool 101 may be in motion and the probes 218, 220 and the stabilizers 228, 230 may be extended to sample the formation fluids at any suitable location in the wellbore 104. Other probe sections include focused sampling probes, oval probes, or packers. Also, although two probes 218, 220 and two stabilizers 228, 230 are shown, the formation testing tool 101 may include any suitable amount of probes and stabilizers, including one probe and one stabilizer or more.

In examples, the channel 206 may be connected to other tools disposed on the drillstring 102 (e.g., referring to FIG. 1). In examples, the formation testing tool 101 may also include a quartz gauge section 208, which may include sensors to allow measurement of properties, such as temperature and pressure, of fluid in the channel 206. Additionally, the formation testing tool 101 may include a flow-control pump-out section 210, which may include a high-volume bidirectional pump 212 for pumping fluid through the channel 206. In examples, the formation testing tool 101 may include two multi-chamber sections 214, 216, referred to collectively as multi-chamber sections 214, 216 or individually as first multi-chamber section 214 and second multi-chamber section 216, respectively.

Without limitation, the formation testing tool 101 may be used in pressure testing operations to perform a pressure test that includes at least two parts. The first is a drawdown during which fluid is withdrawn from the formation and which may require high power to create sufficient volume for the fluid to flow into. The second is a buildup phase where the volume is held steady and a pressure buildup is measured. For example, during pressure testing operations, the probes 218, 220 may be pressed against the inner wall of wellbore 104 (e.g., referring to FIG. 1). Pressure may increase at the probes 218, 220 due to the formation 106 (e.g., referring to FIG. 1) exerting pressure on the probes 218, 220. As pressure rises and reaches a predetermined pressure, valves 232 open and an equalizer valve 234 closes, thereby isolating a fluid passageway 236 from the annulus 128. In this manner, the valve 232 ensures that the equalizer valve 234 closes only after the probes 218, 220 have entered contact with the mudcake (not illustrated) that is disposed against the inner wall of wellbore 104. In examples, as the probes 218, 220 are pressed against the inner wall of the wellbore 104, the pressure rises and closes the equalizer valve 234 in the fluid passageway 236, thereby isolating the fluid passageway 236 from the annulus 128. In this manner, the equalizer valve 234 in the fluid passageway 236 may close before the probes 218, 220 may have entered contact with the mudcake that lines the inner wall of the wellbore 104. The fluid passageway 236, now closed to the annulus 128, is in fluid communication with the low volume pump 226.

As the low volume pump 226 is actuated, formation fluid may thus be drawn through the probe channels 222, 224 and the probes 218, 220. The movement of the a piston in the low volume pump 226 lowers the pressure in the fluid passageway 236 to a pressure below the formation pressure, such that formation fluid is drawn through the probe channels 222, 224 and the probes 218, 220 and into the fluid passageway 236. The pressure of the formation fluid may be measured in the fluid passageway 236 while the probes 218, 220 serves as a seal to prevent annular fluids from entering the fluid passageway 236 and invalidating the formation pressure measurement.

With the piston of the low volume pump 226 in a fully retracted position and formation fluid drawn into the fluid passageway 236, the pressure will stabilize and enable a pressure transducer 238 to sense and measure formation fluid pressure. The measured pressure is transmitted to the information handling system 142 disposed on the formation testing tool 101 and/or it may be transmitted to the surface via mud pulse telemetry or by any other conventional telemetry means to the information handling system 142 disposed on the surface 120.

During this interval, the pressure transducer 238 may continuously monitor the pressure in the fluid passageway 236 until the pressure stabilizes, or after a predetermined time interval. When the measured pressure stabilizes, or after a predetermined time interval, for example at 1800 psi (12.4 MPa), and is sensed by the pressure transducer 238, the drawdown operation may be complete. Once complete, fluid for the pressure test in the fluid passageway 236 may be dispelled from the formation testing tool 101 through the opening and/or closing of the valves 232 and/or the equalizer valve 234 as the piston in the low volume pump 226 returns to a starting position.

The formation testing tool 101 is able to operate while drilling fluids remain circulating in borehole 38, which will minimize the possibility of the tool assembly sticking, allow data to be transmitted to the surface for real-time examination and decision making, and allow the centralizing and sampling pistons to be powered by a mud turbine generator which require the continuous flow of drilling fluid to operate. To do so, the formation testing tool 101 includes a generator system which is powered by fluid flow and capable of providing high power to the tool during the drawdown portion of the pressure test. However, the formation testing tool 101 also includes a battery system that can provide enough power to complete the measurement during the buildup phase. Although the formation testing tool includes the generator system, an entire formation pressure test may also be performed with the mud pump turned off and the formation testing tool 101 powered only by the battery system.

Figure 3:
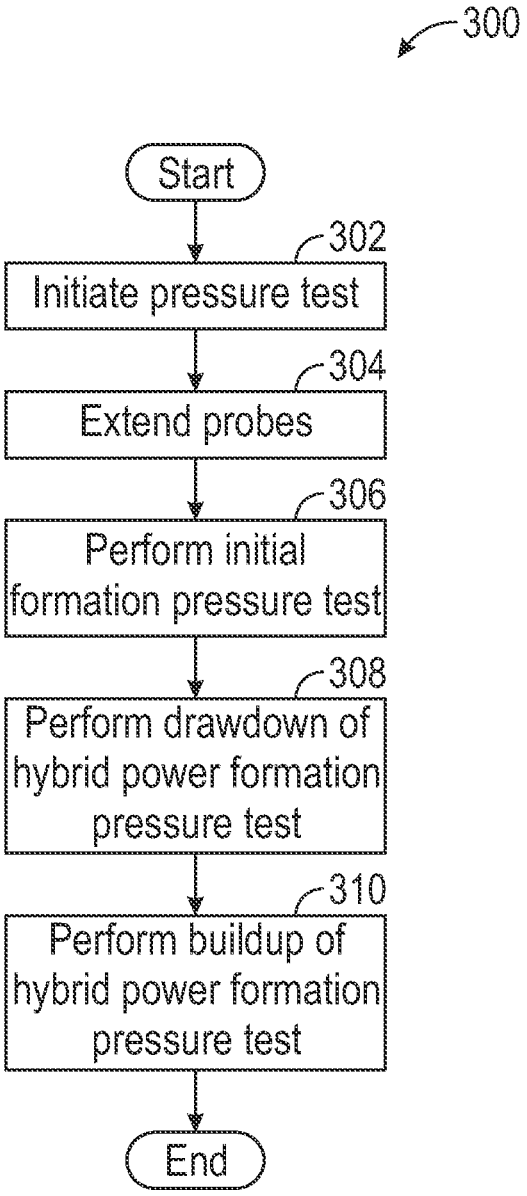
FIG. 3 is a flow chart illustrating an example method of performing a formation pressure test using the formation testing tool in accordance with one or more embodiments.

FIG. 3 illustrates an example method 300 for utilizing the formation testing tool 101 with dual power sources to achieve improved measurement quality during a pressure test in accordance with one or more embodiments. At step 302, with the mud pump 124 on, to initiate the test, the information handling system 142 sends a control signal from the surface 120 to the formation testing tool 101 initiate a pressure test. At step 304, the testing tool 101 begins the formation pressure test by extending the probes 218, 220 and the stabilizers 228, 230 into contact with the formation.

At step 306, the formation testing tool 101 may perform one or more initial formation pressure tests with the pump 124 on to estimate the formation pressure and determine the desired drawdown parameters (e.g., drawdown rate, drawdown volume) for a formation pressure test at the location. These results may be communicated to the information handling system 142 on the surface 120 via mud pulse telemetry using the power and telemetry section 202. The number of these initial formation pressure tests may be configured prior to testing at a given location in the wellbore 104.

The formation testing tool 101 then performs a hybrid power pressure test. For the hybrid test, at step 308, the pump 124 is on such that the generator may provide power to perform the drawdown portion of a pressure test, thus enabling a faster increase in drawdown volume than would be possible under battery power.

To continue the hybrid power formation pressure test, at step 310, after the drawdown portion the formation testing tool 101 coordinates with the information handling system 142 to control the pump 124 to turn off the pump 124. For example, a mud pulse telemetry signal may be sent from the power and telemetry section 202 to the information handling system 142 indicating that the drawdown portion of the hybrid power pressure test is complete. The information handling system 142 could then turn off the pump 124 for the buildup phase of the hybrid power pressure test. Alternatively, the power and telemetry section 202 may send a mud pulse telemetry message to the information handling system 142 at the surface 120 at the beginning of the drawdown, and this message can contain an encoding of the time that the drawdown requires. The information handling system 142 can then time the turning off the pump 124 to coincide with the end of the drawdown. In yet another alternative, the information handling system 142 at the surface 120 may send a message downhole to the testing tool 101 to begin the drawdown and then wait the known length of time of the drawdown plus the latency of the message reception before beginning the drawdown to turn off the pump 124. The buildup phase of the hybrid power pressure test would then occur using only battery power. The reduced pressure noise from not running the pump 124 would allow for an improved final measurement of the formation pressure. Since the pump 124 is off and mud pulse telemetry is not available, the data related to the buildup portion of the hybrid formation pressure test may be store in the memory of the fluid analysis module 138. The data may later be retrieved and communicated to the information handling system 142 when the pump 124 is turned back on and mud pulse telemetry is possible.

To switch from being powered by the generator to being powered by the battery, the formation testing tool 101 may use the computer or controller in the power and telemetry section 202 as well as a pressure sensor in the testing tool 101. The computer and the pressure sensor determine when the pump 124 has been turned off and therefore the generator is not available to provide power. The formation testing tool 101 then switches to being powered by the battery. Alternatively, the testing tool 101 may monitor the voltage output by the generator using a voltage sensor and when the voltage drops below a designated minimum threshold, the testing tool 101 switches to being powered by the battery.

The results of both the initial formation pressure test(s) and the hybrid power formation pressure tests are then processed by the information handling system 142. The information handling system 142 uses the results from the tests to determine at least one characteristic of the formation 106. For example, the information handling system 142 may determine characteristics such as mobility and formation fluid viscosity that can be used to determine formation permeability. The formation pressure can also be used to determine if there is any supercharging, which can mean the formation pressure near the wall of the wellbore, or sandface, is high. If the formation is lower permeability, supercharging may be difficult to overcome. The characteristics of the formation 106 or any other information relating to the testing may also be displayed on the monitor 146 or any other type of physical print out for viewing by rig personnel. The determined characteristics may then be used in making decisions regarding the drilling of the wellbore, such as whether the location of the pressure tests is appropriate for the production of formation fluids, such as oil and gas. Or, whether the wellbore should continue to be drilled.

Alternatively, although the formation testing tool 101 includes the generator, an entire formation pressure test may be performed with the mud pump turned off and the formation testing tool 101 powered only by the battery. In such a test, even the drawndown portion of the formation pressure test may be performed with the formation testing tool 101 being powered only by the battery. The results would be processed similarly as described above.

Figure 4:
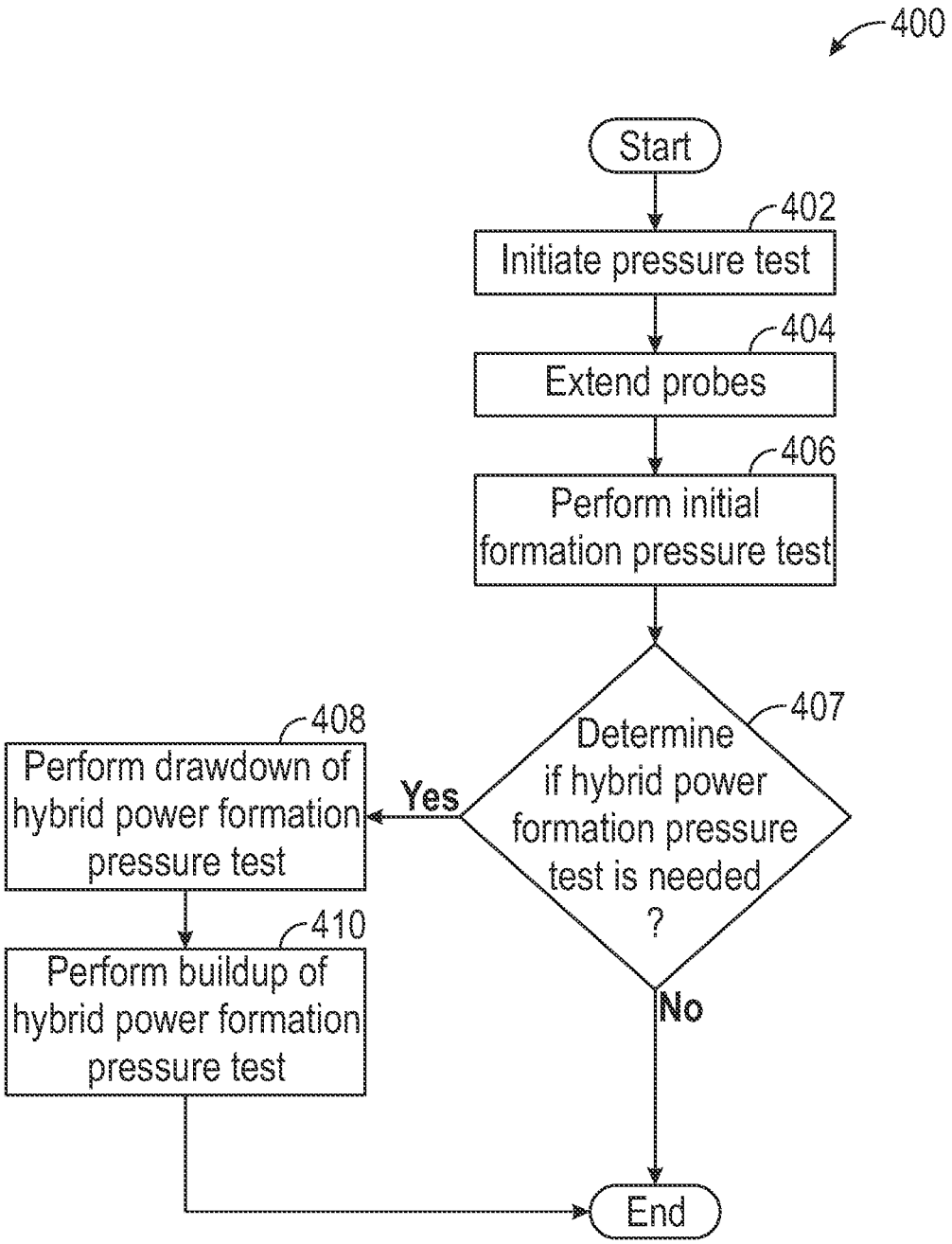
FIG. 4 is a flow chart illustrating another example method of performing a formation pressure test using the formation testing tool in accordance with one or more embodiments.

FIG. 4 illustrates an example method 400 for utilizing the formation testing tool 101 with dual power sources to achieve improved measurement quality during a pressure test in accordance with one or more embodiments. The method 400 includes some similar portions as the method 300 described in FIG. 3 except in the method 400, the hybrid power formation pressure test is not necessarily performed, despite the formation testing tool 101 including a power and telemetry section 202 with dual power sources of a generator and a battery.

As with method 300, at step 402, with the mud pump 124 on, to initiate the test, the information handling system 142 sends a control signal from the surface 120 to the formation testing tool 101 initiate a pressure test. At step 404, the testing tool 101 begins the formation pressure test by extending the probes 218, 220 and the stabilizers 228, 230 into contact with the formation.

At step 406, the formation testing tool 101 may perform one or more initial formation pressure tests with the pump 124 on to estimate the formation pressure and determine the desired drawdown parameters (e.g., drawdown rate, drawdown volume). These results may be communicated to the surface via mud pulse telemetry using the power and telemetry section 202. The number of these initial formation pressure tests may be configured prior to testing at a given location in the wellbore 104.

However, at step 407, the method 400 includes the testing tool 101 or the information handling system 142 at the surface 120 being used to determine whether a hybrid power formation pressure test needs to be performed. Various methods may be used to determine whether a hybrid power test needs to be performed, all of which are based at least in some part on the data received from the initial formation pressure tests and whether the data was of sufficient quality or accuracy so as to be effective. For example, the mobility of the formation 106 may be calculated from the initial formation pressure tests and can be used to determine when to leave pumps on or pumps off for any additional testing. If the mobility of the formation 106 is below a designated threshold, then the hybrid power formation pressure test may be performed. Alternatively, or in addition, the noise in the data due to fluid flow may be examined to determine if the noise in the data is above a designated threshold. If so, then the hybrid power formation pressure test may be performed. With the pump 124 off in the hybrid formation pressure test, pump (or circulation) induced formation pressure variances (circulation variances) that are not representative of formation pressure are not an issue.

If the information handling system 142 determines that the mobility is too low or that the noise is too high, the information handling system 142 controls the testing tool 101 to perform a hybrid power formation pressure test. For the hybrid test, at step 408, the pump 124 is on such that the generator may provide power to perform the drawdown portion of a pressure test, thus enabling a faster increase in drawdown volume than would be possible under battery power.

To continue the hybrid power formation pressure test, at step 410, after the drawdown the formation testing tool 101 coordinates with the information handling system 142 to control the pump 124 to turn off the pump 124. The buildup phase of the hybrid power pressure test would then occur using only battery power. The reduced pressure noise from not running the pump 124 would allow for an improved final measurement of the formation pressure. However, it should also be appreciated that a hybrid formation pressure test may still be performed, even if the mobility of the formation is sufficiently high or the noise is sufficiently low.

Alternatively, although the formation testing tool 101 includes the generator, an entire formation pressure test may be performed with the mud pump turned off and the formation testing tool 101 powered only by the battery. In such a test, even the drawndown portion of the formation pressure test may be performed with the formation testing tool 101 being powered only by the battery. The results would be processed similarly as described above.

Figure 5:
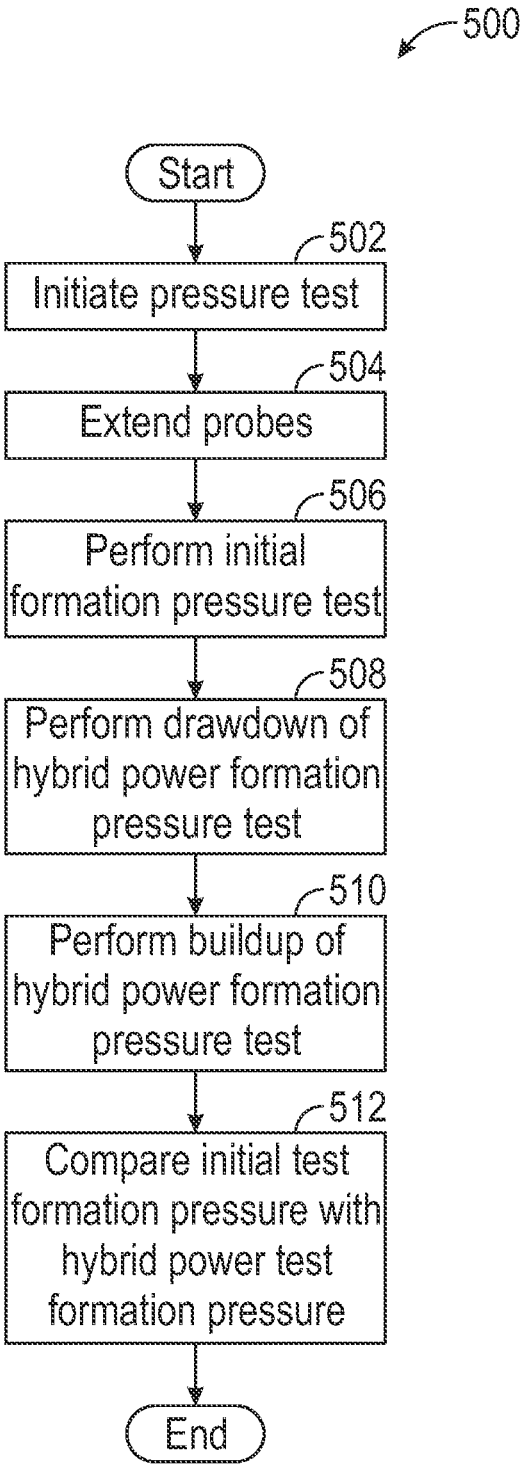
FIG. 5 is a flow chart illustrating an example method of testing the efficiency of a mud cake using the formation testing tool in accordance with one or more embodiments.

In another embodiment, the formation testing tool 101 may be used to test the efficiency of a mud cake formed on the wall for the wellbore 104. Mud cake efficiency or damage can mean there is an inflow of fluid increasing the near wellbore pressure of the formation. FIG. 5 illustrates an example method 500 for utilizing the formation testing tool 101 with dual power sources to determine the efficiency of a mud cake formed on the wall of the wellbore 104 in accordance with one or more embodiments. The method 500 includes similar portions as the method 300 described in FIG. 3 as indicated with similar reference numbers, the discussion of which will not be repeated. In the method 500 however, after the initial formation pressure tests have been performed to determine the formation pressure (initial) and the hybrid power formation pressure test has been performed to determine the formation pressure (hybrid), at step 512, the initial formation pressure and the hybrid formation pressures are compared to determine if there is a difference. If the formation pressures are the same or similar, except for noise caused by the fluid circulation, the mud cake is operating efficiently and is likely not damaged. If the formation pressures are different, however, the mud cake is not operating efficiently and is likely damaged. As above, it should be understood that in the example method 500, although the formation testing tool 101 includes the generator, an entire formation pressure test may be performed with the mud pump turned off and the formation testing tool 101 powered only by the battery. In such a test, even the drawndown portion of the formation pressure test may be performed with the formation testing tool 101 being powered only by the battery. The results would be processed similarly as described above.

Examples of the above embodiments include:

Example 1 is a method of performing a formation pressure test, comprising inserting a bottom hole assembly ("BHA") into a wellbore from the earth's surface to a first location within the wellbore through a subterranean formation. The BHA comprises a drill bit; and a formation testing tool comprising a battery and a fluid powered generator, both of which are configured to power the formation testing tool during a formation pressure test. The method further comprises performing an initial formation pressure test with the formation testing tool and powering the formation testing tool with the fluid powered generator during the entire initial test while fluid is circulating in the wellbore. The method further comprises performing at least a portion of a formation pressure test with the formation testing tool while powering the formation testing tool with the battery while the fluid powered generator is unavailable due to insufficient fluid circulation in the wellbore. The method further comprises determining, using a processor, at least one characteristic of the formation based on results of the initial formation pressure test and the hybrid power formation pressure test.

In Example 2, the embodiments of any preceding paragraph or combination thereof further including performing all of the formation pressure test while powering the formation testing tool with the battery while the fluid powered generator is unavailable due to insufficient fluid circulation in the wellbore.

In Example 3, the embodiments of any preceding paragraph or combination thereof further including performing at least a portion of the formation pressure test while powering the formation testing tool with the fluid powered generator while fluid is circulating in the wellbore.

In Example 4, the embodiments of any preceding paragraph or combination thereof further include controlling the performing of the initial formation pressure test and the formation pressure test using an information handling system at the surface and comprising a controller.

In Example 5, the embodiments of any preceding paragraph or combination thereof further include wherein powering the formation testing tool with the fluid powered generator further comprises circulating fluid in the wellbore using a pump at the earth's surface and controlling operation of the pump with the information handling system.

In Example 6, the embodiments of any preceding paragraph or combination thereof further include communicating between the information handling system and the formation testing tool during or at the beginning of the formation pressure test to turn off the pump.

In Example 7, the embodiments of any preceding paragraph or combination thereof further include communicating, using the BHA, the results of the initial formation pressure test and the formation pressure test with the information handling system and wherein determining the at least one characteristic of the formation further comprises using a processor in the information handling system.

In Example 8, the embodiments of any preceding paragraph or combination thereof further include determining, using a processor, desired drawdown parameters for the formation pressure test using the parameters and the results of the initial formation pressure test.

In Example 9, the embodiments of any preceding paragraph or combination thereof further include comparing, using a processor, the results of the initial formation pressure test with the results of the formation pressure test to determine an efficiency of a mud cake formed on a wall of the wellbore.

In Example 10, the embodiments of any preceding paragraph or combination thereof further include continuing to drill the wellbore with the drill bit to a second location after the formation pressure test and performing another initial formation pressure test and another formation pressure test at the second location.

Example 11 is a system for performing a formation pressure test in a wellbore extending from the earth's surface through a subterranean formation. The system comprises a bottom hole assembly ("BHA") comprising a drill bit and a formation testing tool comprising a battery and a fluid powered generator, both of which are configured to power the formation testing tool during a formation pressure test. The formation testing tool is configured to perform an initial formation pressure test powered by the fluid powered generator from fluid circulating in the wellbore during the entire initial formation pressure test. Also, the formation testing tool is configured to perform at least a portion of a formation pressure test powered by the battery while the fluid powered generator is unavailable due to insufficient fluid circulation in the wellbore.

In Example 12, the embodiments of any preceding paragraph or combination thereof further include wherein the formation testing tool is further configured to perform all of the formation pressure test while powering the formation testing tool with the battery while the fluid powered generator is unavailable due to insufficient fluid circulation in the wellbore.

In Example 13, the embodiments of any preceding paragraph or combination thereof further include wherein the formation testing tool is further configured to perform at least a portion of the formation pressure test while powering the formation testing tool with the fluid powered generator while fluid is circulating in the wellbore.

In Example 14, the embodiments of any preceding paragraph or combination thereof further include an information handling system at the surface and comprising a controller, the information handling system being configured to control the formation testing tool.

In Example 15, the embodiments of any preceding paragraph or combination thereof further include a pump configured to circulate the fluid in the wellbore to power the fluid powered generator and also configured to be controllable by the information handling system.

In Example 16, the embodiments of any preceding paragraph or combination thereof further include wherein the information handling system and the formation testing tool are operable to communicate with each other during or at the beginning of the formation pressure test to turn off the pump for the second portion of the test.

In Example 17, the embodiments of any preceding paragraph or combination thereof further include wherein the BHA further comprises a telemetry system configured to communicate the results of the initial formation pressure test and the formation pressure test with the information handling system and wherein the information handling system further comprises a processor configured to determine at least one characteristic of the formation based on results of the initial formation pressure test and the formation pressure test.

In Example 18, the embodiments of any preceding paragraph or combination thereof further include wherein the information handling system is configured to determine desired drawdown parameters for the formation pressure test using the parameters and the results of the initial formation pressure test.

In Example 19, the embodiments of any preceding paragraph or combination thereof further include wherein the information handling system comprises a processor configured to compare the results of the initial formation pressure test with the results of the formation pressure test to determine an efficiency of a mud cake formed on a wall of the wellbore.

In Example 20, the embodiments of any preceding paragraph or combination thereof further include wherein the drill bit is operable to continue to drill the wellbore after the performance of the formation pressure test and the formation testing tool is operable to perform multiple initial formation pressure tests and multiple formation pressure tests at different locations in the wellbore.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of information. Such a user interface can be operated in conjunction with the communications unit and the bus. Various components of the system can be integrated such that processing identical to or similar to the processing schemes discussed with respect to various embodiments herein can be performed.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of performing a formation pressure test, comprising:

inserting a bottom hole assembly ("BHA") into a wellbore from the earth's surface to a first location within the wellbore through a subterranean formation, wherein the BHA comprises:

a drill bit; and a formation testing tool comprising a battery and a fluid powered generator, both of which are configured to power the formation testing tool during a formation pressure test;

performing an initial formation pressure test with the formation testing tool and powering the formation testing tool with the fluid powered generator during the entire initial test while fluid is circulating in the wellbore;

determining, using a processor, drawdown parameters for a drawdown phase of the formation pressure test using the parameters and the results of the initial formation pressure test, wherein the formation pressure test comprises the drawdown phase and a buildup phase;

performing at least a portion of the formation pressure test with the formation testing tool while powering the formation testing tool with the battery while the fluid powered generator is unavailable due to insufficient fluid circulation in the wellbore; and determining, using the processor, at least one characteristic of the formation based on results of the initial formation pressure test and the formation pressure test.

2. The method of claim 1, further comprising performing all of the formation pressure test while powering the formation testing tool with the battery while the fluid powered generator is unavailable due to insufficient fluid circulation in the wellbore.

3. The method of claim 1, further comprising performing at least a portion of the formation pressure test while powering the formation testing tool with the fluid powered generator while fluid is circulating in the wellbore.

4. The method of claim 3, further comprising controlling the performing of the initial formation pressure test and the formation pressure test using an information handling system at the surface and comprising a controller.

5. The method of claim 4, wherein powering the formation testing tool with the fluid powered generator further comprises circulating fluid in the wellbore using a pump at the earth's surface and controlling operation of the pump with the information handling system.

6. The method of claim 5, further comprising communicating between the information handling system and the formation testing tool during or at the beginning of the formation pressure test to turn off the pump.

7. The method of claim 5, further comprising communicating, using the BHA, the results of the initial formation pressure test and the formation pressure test with the information handling system and wherein determining the at least one characteristic of the formation further comprises using a processor in the information handling system.

8. The method of claim 1, further comprising comparing, using the processor, the results of the initial formation pressure test with results of the formation pressure test to determine an efficiency of a mud cake formed on a wall of the wellbore.

9. The method of claim 1, further comprising continuing to drill the wellbore with the drill bit to a second location after the formation pressure test and performing another initial formation pressure test and another formation pressure test at the second location.

10. A system for performing a formation pressure test in a wellbore extending from the earth's surface through a subterranean formation, the system comprising:

a bottom hole assembly ("BHA") comprising:

a drill bit; and a formation testing tool comprising a battery and a fluid powered generator, both of which are configured to power the formation testing tool during a formation pressure test; and an information handling system at the surface and comprising a controller, the information handling system being configured to control the formation testing tool, wherein the formation testing tool is configured to perform an initial formation pressure test powered by the fluid powered generator from fluid circulating in the wellbore during the entire initial formation pressure test, wherein the information handling system is configured to determine drawdown parameters for a drawdown phase of a formation pressure test using the parameters and the results of the initial formation pressure test, wherein the formation pressure test comprises the drawdown phase and a buildup phase, and wherein the formation testing tool is configured to perform at least a portion of the formation pressure test powered by the battery while the fluid powered generator is unavailable due to insufficient fluid circulation in the wellbore.

11. The system of claim 10, wherein the formation testing tool is further configured to perform all of the formation pressure test while powering the formation testing tool with the battery while the fluid powered generator is unavailable due to insufficient fluid circulation in the wellbore.

12. The system of claim 10, wherein the formation testing tool is further configured to perform at least a portion of the formation pressure test while powering the formation testing tool with the fluid powered generator while fluid is circulating in the wellbore.

13. The system of claim 10, further comprising a pump configured to circulate the fluid in the wellbore to power the fluid powered generator and also configured to be controllable by the information handling system.

14. The system of claim 13, wherein the information handling system and the formation testing tool are operable to communicate with each other during or at the beginning of the formation pressure test to turn off the pump.

15. The system of claim 10, wherein:

the BHA further comprises a telemetry system configured to communicate results of the initial formation pressure test and the formation pressure test with the information handling system; and the information handling system further comprises a processor configured to determine at least one characteristic of the formation based on the results of the initial formation pressure test and the formation pressure test.

16. The system of claim 10, wherein the information handling system comprises a processor configured to compare results of the initial formation pressure test with results of the formation pressure test to determine an efficiency of a mud cake formed on a wall of the wellbore.

17. The system of claim 10, wherein the drill bit is operable to continue to drill the wellbore after the performance of the formation pressure test and the formation testing tool is operable to perform multiple initial formation pressure tests and multiple formation pressure tests at different locations in the wellbore.

* * * * *